US009501959B2

(12) United States Patent
Kim et al.

(10) Patent No.: US 9,501,959 B2
(45) Date of Patent: Nov. 22, 2016

(54) MOTHER SUBSTRATE WITH SWITCH DISCONNECTING TEST PART, ARRAY TEST METHOD THEREOF AND DISPLAY SUBSTRATE

(71) Applicant: SAMSUNG DISPLAY CO., LTD., Yongin, Gyeonggi-Do (KR)

(72) Inventors: Ji-Sun Kim, Seoul (KR); Chong-Chul Chai, Seoul (KR); Yeong-Keun Kwon, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 80 days.

(21) Appl. No.: 14/320,797

(22) Filed: Jul. 1, 2014

(65) Prior Publication Data

US 2015/0084666 A1 Mar. 26, 2015

(30) Foreign Application Priority Data

Sep. 25, 2013 (KR) ..... 10-2013-0113855

(51) Int. Cl.
*G09G 3/00* (2006.01)
*G09G 3/36* (2006.01)

(52) U.S. Cl.
CPC ..... *G09G 3/006* (2013.01); *G09G 3/36* (2013.01); *G09G 2330/04* (2013.01); *G09G 2330/06* (2013.01); *G09G 2330/12* (2013.01)

(58) Field of Classification Search
CPC ..... G09G 2300/0426; G09G 3/3674; G09G 2300/0408; G09G 3/3648; G09G 2300/0439; G09G 2300/08; G09G 2310/0283; G09G 3/003; G09G 3/2003; G09G 3/3611; G09G 3/3688; G09G 2300/0434; G09G 2320/0204; G09G 3/006; G09G 2330/04; G09G 2330/12; G09G 3/36; G01R 31/2856; G02F 2001/136254; G02F 1/1345; G02F 1/13458; G02F 1/1362; G02F 1/136204; G02F 1/136286; G02F 2001/133388; H01L 27/0248; H01L 27/1214; H01L 27/1288
See application file for complete search history.

(56) References Cited

U.S. PATENT DOCUMENTS

| | | | | |
|---|---|---|---|---|
| 7,019,796 | B2 | 3/2006 | Tsai et al. | |
| 7,456,647 | B2 * | 11/2008 | Jeon | G09G 3/006 324/760.01 |
| 8,279,147 | B2 * | 10/2012 | Lee | G09G 3/006 345/87 |
| 8,310,478 | B2 | 11/2012 | Kumagai et al. | |
| 2013/0002738 | A1 | 1/2013 | Lu | |
| 2013/0062607 | A1 | 3/2013 | Yamazaki et al. | |
| 2013/0088679 | A1 | 4/2013 | Lu | |
| 2014/0203835 | A1 * | 7/2014 | Ro | H01L 27/1251 324/760.02 |

FOREIGN PATENT DOCUMENTS

| | | | |
|---|---|---|---|
| JP | 2002-099224 | A | 4/2002 |
| JP | 2003-322874 | A | 11/2003 |
| KR | 10-2005-0004411 | A | 1/2005 |
| KR | 10-2013-0031054 | A | 3/2013 |

* cited by examiner

*Primary Examiner* — Vinh Nguyen
(74) *Attorney, Agent, or Firm* — Lee & Morse P.C.

(57) ABSTRACT

A mother substrate includes a display substrate cell defined by a scribe line, the display substrate cell including a plurality of gate lines, a gate circuit part driving the gate lines, and a gate pad part connected to the gate circuit part, a gate test pad part in a peripheral area surrounding the display substrate cell, the gate test pad part being configured to receive a gate test signal, a gate test line part connecting the gate test pad part and the gate pad part, and a switching part connected to the gate test line part and configured to control turning on and turning off of the gate test line part.

17 Claims, 7 Drawing Sheets

MOTHER SUBSTRATE WITH SWITCH DISCONNECTING TEST PART, ARRAY TEST METHOD THEREOF AND DISPLAY SUBSTRATE

CROSS-REFERENCE TO RELATED APPLICATION

Korean Patent Application No. 10-2013-0113855, filed on Sep. 25, 2013, in the Korean Intellectual Property Office, and entitled: "Mother Substrate, Array Test Method Thereof and Display Substrate," is incorporated by reference herein in its entirety.

BACKGROUND

1. Field

Exemplary embodiments relate to a mother substrate, an array test method thereof, and a display substrate. More particularly, example embodiments relate to a mother substrate that protects from static electricity, an array test method thereof, and a display substrate.

2. Description of the Related Art

Generally, a liquid crystal display (LCD) panel includes a display substrate which includes a plurality of gate lines, a plurality of data lines, and a plurality of pixels, a gate driving circuit which outputs gate signals to the gate lines, and a data driving circuit which output data signals to the data lines. The gate driving circuit and the data driving circuit are mounted on the display substrate, e.g., a chip shape.

Each pixel includes a pixel electrode and a thin film transistor. The thin film transistor is connected to the data line, the gate line, and the pixel electrode, and drives the pixel electrode.

Currently, in order to decrease a total size of the gate driving circuit and to reduce the size of a LCD, as well as to simplify the manufacture of the LCD, a process in which the gate driving circuit is integrated on the display substrate has been developed. The gate driving circuit includes a thin film transistor which is formed via a substantially same process as that forming the thin film transistor of the pixel. Thus, the thin film transistor of the gate driving circuit includes the same active layer as that in the thin film transistor of the pixel.

SUMMARY

According to an exemplary embodiment, there is provided a mother substrate. The mother substrate includes a display substrate cell defined by a scribe line, the display substrate cell including a plurality of gate lines, a gate circuit part driving the gate lines, and a gate pad part connected to the gate circuit part, a gate test pad part in a peripheral area surrounding the display substrate cell, the gate test pad part being configured to receive a gate test signal, a gate test line part connecting the gate test pad part and the gate pad part, and a switching part connected to the gate test line part and configured to control turning on and turning off of the gate test line part.

In an exemplary embodiment, the gate test pad part may include a test control pad configured to receive a test control signal which controls an operation of the switching part; and a plurality of gate test pads configured to receive a plurality of gate test signals which controls an operation of the gate circuit part.

In an exemplary embodiment, the switching part may include a plurality of switching elements connecting the gate test pad part and the gate pad part in parallel, the switching elements driving in response to the test control signal.

In an exemplary embodiment, each of the switching elements may include a plurality of transistors connected to each other in series, the transistors driving in response to the test control signal.

In an exemplary embodiment, the switching part may include a switching element connecting the gate test pad part and the gate pad part, the switching element comprising a plurality of transistors which connected to each other in series.

In an exemplary embodiment, the switching part may be disposed in an area adjacent to an area in which the gate pad part is disposed.

In an exemplary embodiment, the switching part may be disposed in an outside area of the display substrate cell with respect to the scribe line.

In an exemplary embodiment, the switching part may be disposed in an inside area of the display substrate cell with respect to the scribe line.

In an exemplary embodiment, the gate test signals may include a plurality of clock signals, a plurality of OFF signals and at least one vertical start signal which drive the gate circuit part.

In an exemplary embodiment, the gate circuit part may include a plurality of circuit transistors, each of the circuit transistors comprising oxide semiconductor.

In an exemplary embodiment, the gate circuit part may include a plurality of circuit transistors, each of the circuit transistors comprising amorphous silicon.

According to another exemplary embodiment, there is also provided an array test method of a mother substrate for a display substrate cell which comprises a plurality of data lines, a plurality of gate lines, a gate circuit part driving the gate lines and a gate pad part connected to the gate circuit part. The array test method includes turning on a gate test line part which connects a gate pad part and a gate test pad part receiving a gate test signal during an array test process of the display substrate cell, and turning off the gate test line part before and after the array test process.

In an exemplary embodiment, the array test method may further include turning on a switching part during the array test process and turning off the switching part before and after the array test process, wherein the a switching part is connected to the gate test line part.

In an exemplary embodiment, the array test method may further include applying a test control signal which turns on the switching part to a test control pad during the array test process, and applying a test control signal which turns off the switching part to the test control pad before and after the array test process, wherein the gate test pad part comprises the test control pad.

In an exemplary embodiment, the switching part may include a plurality of switching elements which connects the gate test pad part and the gate pad part in parallel.

In an exemplary embodiment, each the switching elements may include a plurality of transistors in series.

In an exemplary embodiment, the switching part may include a switching element which connects the gate test pad part and the gate pad part, and the switching element comprises a plurality of transistors in series.

In an exemplary embodiment, the array test method may further include applying a data test signal to a data pad part which is connected to the data lines during the array test process.

According to another exemplary embodiment, there is also provided a display substrate. The display substrate includes a plurality of gate lines disposed in a display area, a plurality of data lines crossing the gate lines, a gate circuit part disposed in a peripheral area crossing the display area and configured to drive the gate lines, a gate pad part connected to the gate circuit part and configured to receive a gate driving signal, and a switching part disposed adjacent to the gate pad part and connected to the gate pad part.

In an exemplary embodiment, the switching part may include a plurality of switching elements which is connected to each other in parallel and each of the switching elements comprises a plurality of transistors which is connected to each other in series.

BRIEF DESCRIPTION OF THE DRAWINGS

Features will become apparent to those of ordinary skill in the art by describing in detail exemplary embodiments with reference to the attached drawings. in which.

DETAILED DESCRIPTION

Figure 1:
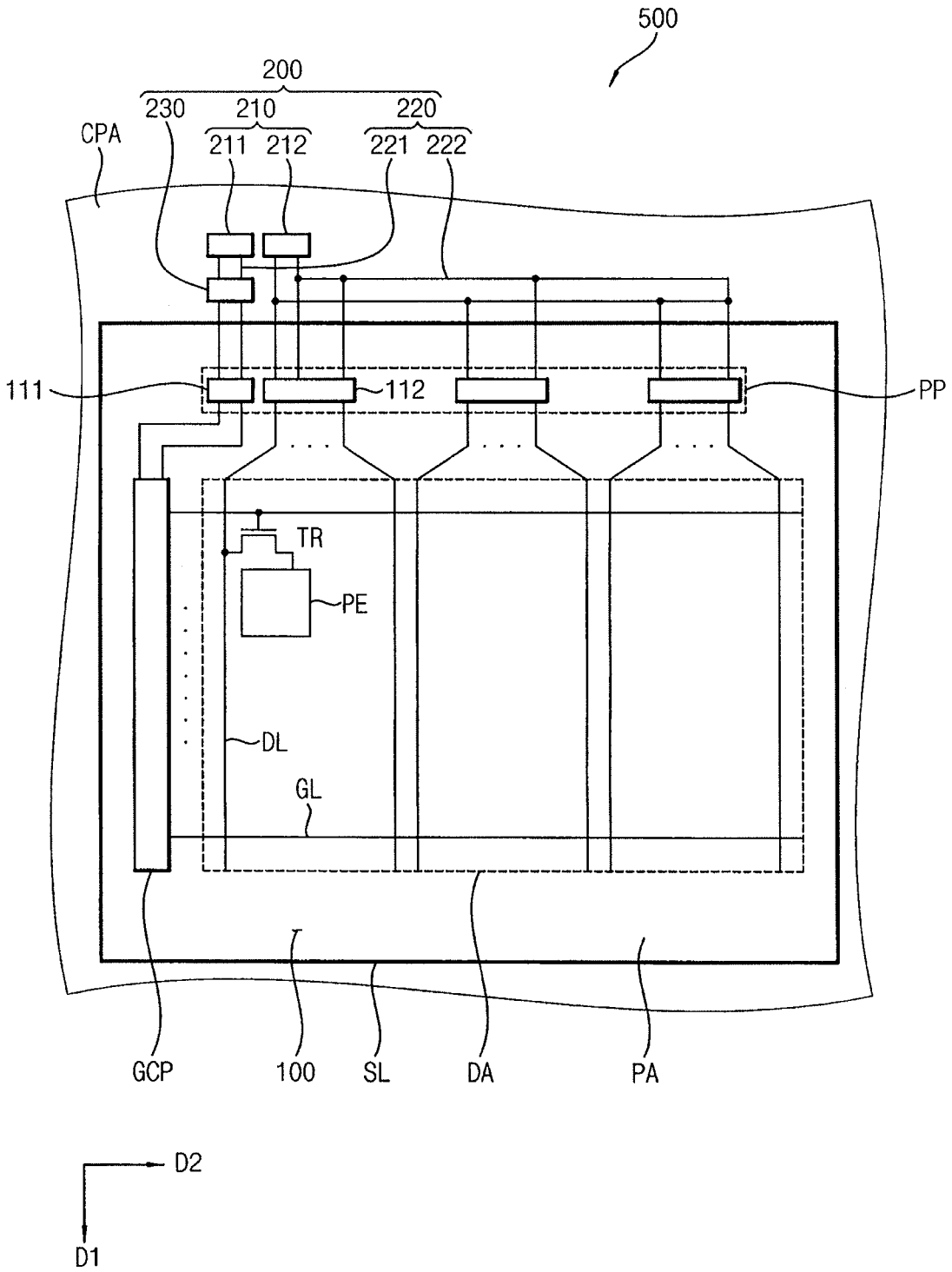
FIG. 1 illustrates a plan view of a mother substrate for a display substrate according to an exemplary embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. In addition, it will also be understood that when a layer or element is referred to as being "between" two layers, it can be the only layer between the two layers, or one or more intervening layers may also be present. Like reference numerals refer to like elements throughout.

FIG. 1 illustrates a plan view of a mother substrate for a display substrate according to an exemplary embodiment.

Referring to FIG. 1, a mother substrate 500 may include a display substrate cell 100 and a cell peripheral area CPA which surrounds the display substrate cell 100. The display substrate cell 100 and the cell peripheral area CPA may be divided based on a scribe line SL, and the display substrate cell 100 may be defined by the scribe line SL. The display substrate cell 100 may include a display area DA and a peripheral area PA surrounding the display area DA.

A plurality of data lines DL, a plurality of gate lines GL, a plurality of pixel transistors TR, and a plurality of pixel electrodes PE are disposed in the display area DA. The data lines DL extend in a first direction D1 and are arranged in a second direction D2 crossing the first direction. The gate lines GL extend in the second direction and are arranged in the first direction D1. The pixel transistors TR are connected to the data lines DL and the gate lines GL. The pixel electrodes PE are respectively connected to the pixel transistors TR.

For example, the pixel transistor TR may include an active layer having an oxide semiconductor. The oxide semiconductor may include an amorphous oxide having at least one of indium (In), zinc (Zn), gallium (Ga), tin (Sn), or hafnium (HF). For example, the oxide semiconductor may include an amorphous oxide having indium (In), zinc (Zn), and gallium (Ga) or an amorphous oxide having indium (In), zinc (Zn), and hafnium (HF). The oxide semiconductor may be, e.g., at least one of indium zinc oxide (InZnO), indium gallium oxide (InGaO), indium tin oxide (InSnO), tin zinc oxide (ZnSnO), tin gallium oxide (GaSnO), and tin gallium oxide (GaZnO). In another example, the active layer of the pixel transistor TR may have amorphous silicon.

A gate circuit part GCP and a pad part PP are disposed in the peripheral area PA of the display substrate cell 100.

The gate circuit part GCP may include a plurality of circuit transistors. The circuit transistors may be formed via a substantially same process as that forming the pixel transistor TR. For example, the circuit transistor may include an active layer having an oxide semiconductor corresponding to the pixel transistor TR. In another example, the circuit transistor may include an active layer having amorphous silicon. The gate circuit part GCP is connected to the gate lines GL. The gate circuit part GCP generates gate signals and provides the gate lines GL with the gate signals.

The pad part PP may include a gate pad part 111, which is connected to the gate circuit part GCP, and a data pad part 112, which is connected to the data lines DL. The gate pad part 111 receives a gate driving signal so that the gate driving signal is applied to the gate circuit part GCP. The gate driving signal may include a vertical start signal, a plurality of clock signals, and a plurality of OFF signals. The data pad part 112 receives data signals so that the data signals are applied to the data lines DL.

An array test part 200 is disposed in the cell peripheral area CPA. The array test part 200 is for an array test process, which inspects a potential electrical fault of the data lines DL and/or the gate lines GL. The array test part 200 may include a test pad part 210, a test line part 220, and a switching part 230.

The array test pad part 210 may include a gate test pad part 211 and a data test pad part 212.

The gate test pad part 211 receives gate test signals corresponding to the gate driving signals to drive the gate circuit part GCP. For example, the gate test signals may include a vertical start signal, a first clock signal, a second clock signal different from the first clock signal, a first OFF signal, and a second OFF signal different from the first OFF signal.

The data test pad part 212 receives data test signals to drive the data lines DL. The data test signals may include at least two test signals. For example, in a 2D array test process, the data test signals may include a first data test signal to drive odd-numbered data lines and a second data test signal to drive even-numbered data lines. In another example, in a 3D array test process, the data test signals may include a first data test signal to drive (3n−2)-th data lines, a second data test signal to drive (3n−1)-th data lines, and a third data test signal to drive (3n)-th data lines. Herein, 'n' is a natural number.

The test line part 220 may include a gate test line part 221 and a data test line part 222. The gate test line part 221 connects the gate test pad part 211 and the gate pad part 111 which is disposed in the display substrate cell 100. The data test line part 222 connects the data test pad part 212 and the data pad part 112 which is disposed in the display substrate cell 100.

The switching part 230 is disposed adjacent to the gate pad part 111 and is connected to the gate test line part 221. The switching part 230 controls a short state and an open state of the gate test line part 221.

According to the present exemplary embodiment, the switching part 230 is turned on during the array test process, so that an electrical signal is transferred through the gate test line part 221 and through the switching part 230 to the gate pad part 111, i.e., as the short state. The switching part 230 is turned off before and after the array test process, so that an electrical signal is not transferred through the gate test line part 221, i.e., as the open state.

Therefore, during the array test process, the gate test line part 221 turns on by the switching part 230, which is turned on, so that a gate test signal is transferred to the gate pad part 111 to perform the array test process. However, before and after the array test process, e.g., during any time that the array test process is not performed, the gate test line part 221 turns off by the switching part 230, which is turned off. Accordingly, any signals, e.g., static electricity, are blocked from flowing, e.g., being transmitted, through the turned off test line part 221 and through the switching part 230 into the display substrate cell 100. Therefore, damage to the gate circuit part GCP, e.g., by static electricity, may be prevented or substantially minimized.

Figure 2:
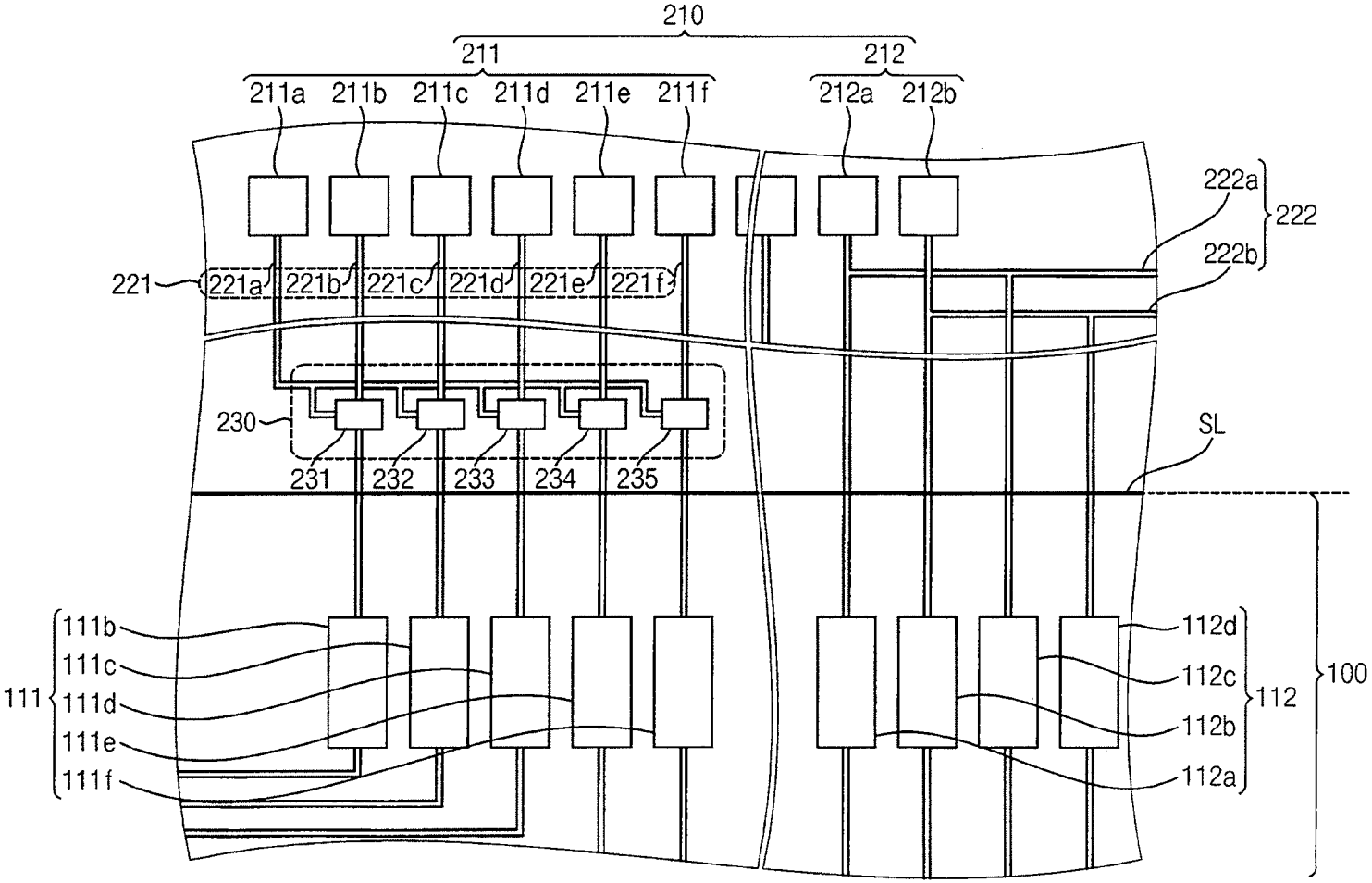
FIG. 2 illustrates a plan view of an array test part shown in FIG. 1.

FIG. 2 illustrates an enlarged and detailed plan view of the array test part 200. Referring to FIGS. 1 and 2, and as discussed previously, the array test part 200 may include the array test pad part 210, the array test line part 220, and the switching part 230.

The array test pad part 210 includes the gate test pad part 211 and the data test pad part 212.

The gate test pad part 211 includes a test control pad 211*a*, which receives a test control signal, and a plurality of gate test pads 211*a*, 211*b*, 211*c*, 211*d*, 211*e* and 211*f*, which receive a plurality of gate test signals.

The test control pad 211*a* receives a test control signal which controls a turn-on state and a turn-off state of the switching part 230. For example, the first gate test pad 211*b* may receive a first clock signal, the second gate test pad 211*c* may receive a second clock signal, the third gate test pad 211*d* may receive a first OFF signal, the fourth gate test pad 211*e* may receive a second OFF signal, and the fifth gate test pad 211*f* may receive a vertical start signal.

The data test pad part 212 includes a plurality of data test pads 212*a* and 212*b* which receive a plurality of data test signals. For example, in the 2D array test process, the first data test pad 212*a* may receive a first data test signal, which is applied to data pads 112*a* and 112*c* of the odd-numbered data lines, and the second data test pad 212*b* may receive a second data test signal, which is applied to data pads 112*b* and 112*d* of the even-numbered data lines.

The array test line part 220 includes the gate test line part 221 and the data test line part 222.

The gate test line part 221 connects the gate test pad part 211 and the gate pad part 111, which is disposed in the display substrate cell 100. The gate pad part 111 may include a first gate pad 111*b*, which receives the first clock signal, a second gate pad 111*c*, which receives the second clock signal, a third gate pad 111*d* which receives the first OFF signal, a fourth gate pad 111*e*, which receives the second OFF signal, and a fifth gate pad 111*f*, which receives the vertical start signal.

The gate test line part 221 includes a test control line 221*a* and a plurality of gate test lines 221*b*, 221*c*, 221*d*, 221*e* and 221*f*. The test control line 221*a* connects the test control pad 211*a* and the switching part 230 and transfers the test control signal to the switching part 230.

The first gate test line 221*b* connects the first gate test pad 211*b* and the first gate pad 111*b* through a first switch 231. The second gate test line 221*c* connects the second gate test pad 211*c* and the second gate pad 111*c* through a second switch 232. The third gate test line 221*d* connects the third gate test pad 211*d* and the third gate pad 111*d* through a third switch 233. The fourth gate test line 221*e* connects the fourth gate test pad 211*e* and the fourth gate pad 111*e* through a fourth switch 234. The fifth gate test line 221*f* connects the fifth gate test pad 211*f* and the fifth gate pad 111*f* through a fifth switch 235.

The data test line part 222 includes a plurality of data test lines 222*a* and 222*b*. The data test lines include a first data test line 222*a* and a second data test line 222*b* corresponding to the 2D array test process. The first data test line 222*a* connects the first data test pad 212*a* and the data pads 112*a* and 112*c* of the odd-numbered data lines, and transfers the first data test signal. The second data test line 222*b* connects the second data test pad 212*b* and the data pads 112*b* and 112*d* of the even-numbered data lines, and transfers the second data test signal.

The switching part 230 includes the first switch 231, second switch 232, third switch 233, fourth switch 234, and fifth switch 235 respectively corresponding to the first to fifth gate test lines 221*b*, 221*c*, 221*d*, 221*e*, and 221*f*.

The first to fifth switches 231, 232, 233, 234, and 235 control the short state and the open state of the first to fifth gate test lines 221*b* 221*c*, 221*d*, 221*e*, and 221*f*, respectively, in response to the test control signal received from the test control pad 211*a*. For example, when the first to fifth switches 231, 232, 233, 234, and 235 are turned on, the first to fifth gate test lines 221*b* 221*c*, 221*d*, 221*e*, and 221*f* are at the short state. When the first to fifth switches 231, 232, 233, 234 and 235 are turned off, the first to fifth gate test lines 221*b* 221*c*, 221*d*, 221*e* and 221*f* are at the open state.

Figure 3:
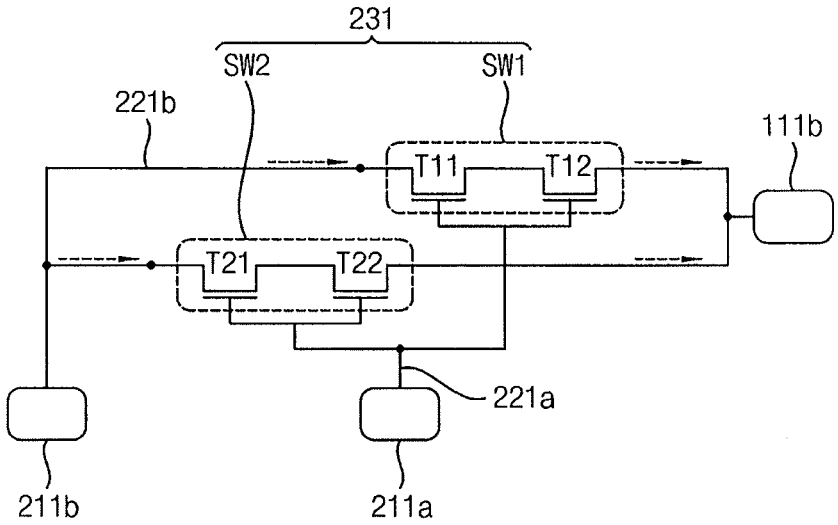
FIG. 3 illustrates an equivalent circuit diagram of an array test part in FIG. 1.
Figure 4:
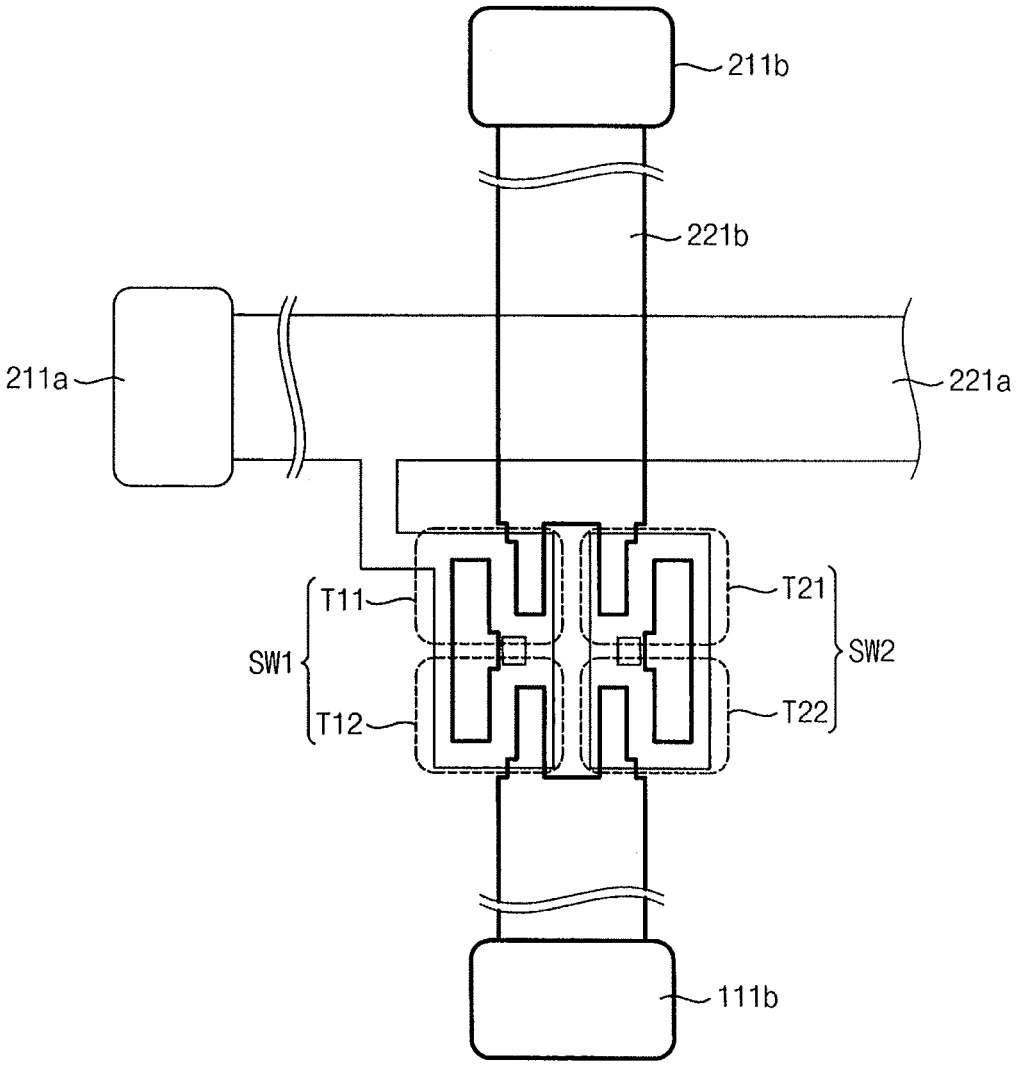
FIG. 4 illustrates a plan view of a switching part shown in FIG. 2.

FIG. 3 illustrates an equivalent circuit diagram of a part of the array test part 200. FIG. 4 illustrates a plan view of the switching part 230.

Referring to FIGS. 3 and 4, each of the first to fifth switches 231, 232, 233, 234, and 235 includes a plurality of switching elements connected to each other in parallel. Each of the switching elements includes a plurality of transistors connected to each other in series.

For example, as shown in FIG. 3, the first switch 231 includes a first switching element SW1 and a second switching element SW2 which are connected to each other in parallel. The first switching element SW1 includes a first transistor T11 and a second transistor T12 which are connected to each other in series. The second switching element SW2 includes a third transistor T21 and a fourth transistor T22 which are connected to each other in series.

Each of the first and second transistors T11 and T12 includes a control electrode, an input electrode, and an output electrode. For example, the control electrode in each of the first and second transistors T11 and T12 may be formed from the same metal layer as the test control line 221*a*, and the input and output electrodes in each of the first and second transistors T11 and T12 may be formed from the same metal layer as the first gate test line 221*b*.

The first transistor T11 includes the control electrode, which is connected to the test control line 221*a*, the input electrode, which is connected to the first gate test line 221*b* adjacent to the first gate test pad 211*a*, and the output electrode, which is connected to the second transistor T12. The second transistor T12 includes the control electrode, which is connected to the test control line 221*a*, the input electrode, which is connected to the output electrode of the first transistor T11, and the output electrode, which is connected to the first gate test line 221*b* adjacent to the first gate pad 111*b*.

Each of the third and fourth transistors T21 and T22 includes a control electrode, an input electrode, and an output electrode. For example, the control electrode of each of the third and fourth transistors T21 and T22 may be formed from the same metal layer as the test control line 221*a*, and the input and output electrodes of each of the third and fourth transistors T21 and T22 may be formed from the same metal layer as the first gate test line 221*b*.

The third transistor T21 includes the control electrode, which is connected to the test control line 221*a*, the input electrode, which is connected to the first gate test line 221*b* adjacent to the first gate test pad 211*a*, and the output electrode which is connected to the fourth transistor T22. The fourth transistor T22 includes the control electrode, which is connected to the test control line 221*a*, the input electrode, which is connected to the output electrode of the third transistor T21, and the output electrode, which is connected to the first gate test line 221*b* adjacent to the first gate pad 111*b*.

The first and second switching elements SW1 and SW2 are turned on or turned off in response to the test control signal received from the test control pad 211*a*. For example, when the test control signal is a turn-on signal, the first and second switching elements SW1 and SW2 are turned on so that the first gate test line 221*b* is at the short state, i.e., the first gate test line 221*b* transmits signals from the first gate test pad 211*b* through the first and second switches SW1 and SW2. The first gate test signal received from the first gate test pad 211*b* is transmitted through the first and second switches SW1 and SW2 and is applied to the first gate pad 111*b*. Thus, the gate circuit part GCP of the display substrate cell 100 receives the gate test signal so that the array test process may be performed.

However, when the test control signal is a turn-off signal, the first and second switching elements SW1 and SW2 are turned off, so that the first gate test line 221*b* is at the open state i.e., the first gate test line 221*b* does not transmit any signals from the first gate test pad 211*b* to the first and second switches SW1 and SW2. Therefore, static electricity potentially received from the first gate test pad 211*b* may be blocked from flowing into the first gate pad 111*b*. Thus, the first and second switching elements SW1 and SW2 control the short state and the open state of the first gate test line 221*b*, so that the static electricity may be blocked from flowing into the gate circuit part GCP of the display substrate cell 100 before and after the array test process.

Figure 5:
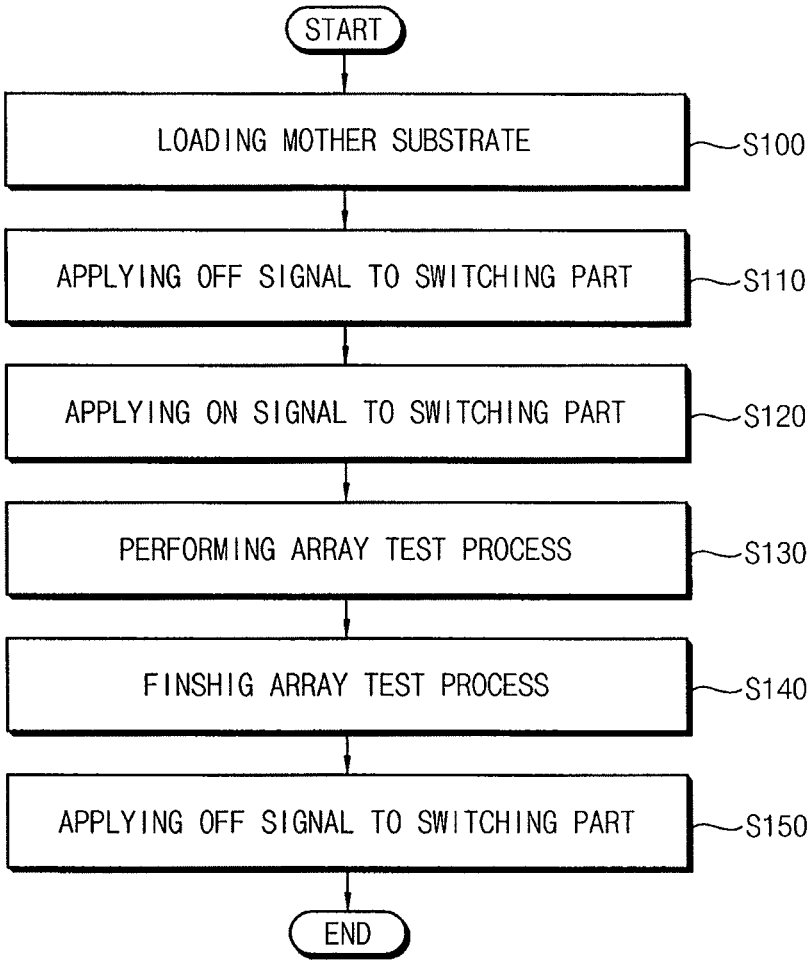
FIG. 5 illustrates a flowchart of an array test method of the mother substrate in FIG. 1.

FIG. 5 illustrates a flowchart of an array test method of the mother substrate 500 shown in FIG. 1.

Referring to FIGS. 1 to 5, the mother substrate 500 is loaded on an array test process apparatus (not shown) (operation S100).

An OFF signal Voff that is a test control signal for turning off the switching part 230 is applied to the test control pad 211*a* of the gate test pad part 211 on the mother substrate 500 (operation S110).

Referring to FIG. 3, when the first and second switching elements SW1 and SW2 of the switching part 230 receive the OFF signal Voff that is the test control signal, the first and second transistors T11 and T12 of the first switching element SW1 are turned off in response to the OFF signal Voff. Similarly, the third and fourth transistors T21 and T22 of the second switching element SW2 are turned off in response to the OFF signal Voff.

The switching part 230 is turned off, and thus, the gate test line part 221 which connects the gate test pad part 211 and the gate pad part 111 of the gate circuit part GCP is at the open state. Thus, before the array test process, the gate test line part 221, which is at the open state by the turned-off switching part 230, may block the static electricity, which may be at the gate test pad part 211, from flowing into the gate circuit part GCP of the display substrate cell 100.

Then, in order to perform the array test process, an ON signal Von that is the test control signal for turning on the switching part 230 is applied to the test control pad 211*a* of the gate test pad part 211 on the mother substrate 500 (operation S120). For example, in order to perform the array test process, the ON signal Von is concurrently applied to the gate test pads 211*a*, 211*b*, 211*c*, 211*d*, 211*e*, and 211*f*, and then data test signals are applied to the data test pads 212*a* and 212*b*.

Referring to FIG. 3, when the first and second switching elements SW1 and SW2 of the switching part 230 receive the ON signal Von, the first and second transistors T11 and T12 of the first switching element SW1 are turned on in response to the ON signal Von. Similarly, the third and fourth transistors T21 and T22 of the second switching element SW2 are turned on in response to the ON signal Von.

The switching part 230 is turned on, and thus, the gate test line part 221, which connects the gate test pad part 211 and the gate pad part 111 of the gate circuit part GCP, is at the short state. Thus, the gate test signals, which are applied to the gate test pads 211*a*, 211*b*, 211*c*, 211*d*, 211*e* and 211*f*, are applied to the gate pads 111*a*, 111*b*, 111*c*, 111*d*, 111*e* and 111*f* of the display substrate cell 100.

Therefore, the gate circuit part GCP generates a plurality of gate signals based on the gate test signals and outputs the plurality of gate signals to the gate lines GL. The data test signals which are applied to the data test pads 212*a* and 212*b* are applied to the data lines DL of the display substrate cell 100. Thus, the array test process of the display substrate cell 100 is performed (operation S130).

After this, when the array test process is finished (operation S140), the OFF signal Voff that is the test control signal is repeatedly applied to the test control pad 211*a* (operation S150).

That is, referring to FIG. 3, when the first and second switching elements SW1 and SW2 of the switching part 230 receive the OFF signal Voff that is the test control signal, the first and second transistors T11 and T12 of the first switching element SW1 are turned off in response to the OFF signal Voff. Similarly, the third and fourth transistors T21 and T22 of the second switching element SW2 are turned off in response to the OFF signal Voff.

The switching part 230 is turned off, and thus, the gate test line part 221, which connects the gate test pad part 211 and the gate pad part 111 of the gate circuit part GCP, is at the open state. Thus, after the array test process, the gate test line part 221, which is the open state by the turned-off switching part 230, may block the static electricity, which is received at the gate test pad part 211, from flowing into the gate circuit part GCP of the display substrate cell 100.

According to the present exemplary embodiment, only during the array test process, the switching part 230 is turned on, so that the array test process is performed. When the array test process is not performed, i.e., before and after the array test process, the switching part 230 is turned off, and thus, the turned off switching part 230 prevents static electricity form flowing into the display substrate cell 100. Therefore, the gate circuit part GCP of the display substrate cell 100 may be protected from static electricity.

Figure 6:
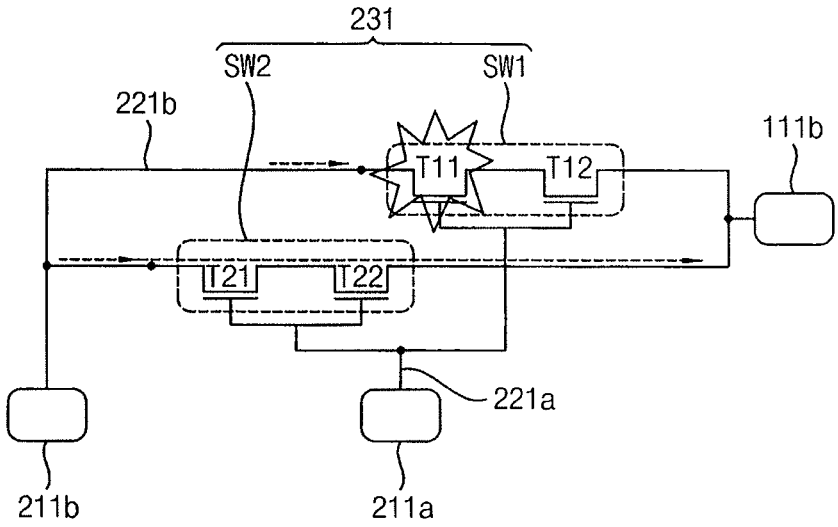
FIG. 6 illustrates a conceptual diagram of an operation of the array test shown in FIG. 1.

FIG. 6 illustrates a conceptual diagram of an operation of the array test shown in FIG. 1.

Referring to FIGS. 1 and 6, according to the present exemplary embodiment, the first switch 231 of the switching part 230 connects the gate test pad 211*b* of the array test part 200 and the gate pad 111*b* of the gate circuit part GCP.

The first switch 231 includes a plurality of switching elements connected to each other in parallel, e.g., the first switch 231 includes the first switching element SW1 and the second switching element SW2. Each of the first and second switching elements SW1 and SW2 includes a plurality of transistors connected to each other in series. The first switching element SW1 includes the first and second transistors T11 and T12 and then, the second switching element SW2 includes the third and fourth transistors T21 and T22.

For example, when the first and second transistors T11 and T12 of the first switching element SW1 are turned off in response to the OFF signal Voff before and after the array test process, if the first transistor T11, i.e., a transistor in a front of the first switching element SW1, is shorted by static electricity, the second transistor T12, i.e., a transistor next of the first transistor T11, may maintain a turn-off state. Thus, the gate test line 221*b* may be maintained at the open state by the second transistor T12 of the first switching element SW1. According to the present exemplary embodiment, at least one of the transistors included in the first switching element SW1 may prevent the static electricity from flowing into the gate pad 111*b* of the gate circuit part GCP.

In addition, when the first and second switching element SW1 and SW2 of the first switch 231 are turned on in response to the ON signal Von during the array test process, if the gate test pad 211*b* of the array test part 200 and the gate pad 111*b* of the gate circuit part GCP are disconnected from the first switching element SW1, e.g., due to damage by the static electricity, the gate test pad 211*b* and the gate pad 111*b* may be connected through the second switching element SW2 which maintains a turn-on state. Thus, the gate test line 221*b* may be maintained at the short state by the second switching element SW2. According to the present exemplary embodiment, the gate test pad 211*b* of the array test part 200 and the gate pad 111*b* of the gate circuit part GCP may be connected through at least one of the switching elements included in the first switch 231 so that the array test process may be normally performed.

As shown in the figures, the first switch 231 may include at least two switching elements connected to each other in parallel, and each of the switching element may include at least two transistors connected to each other in series.

Figure 7:
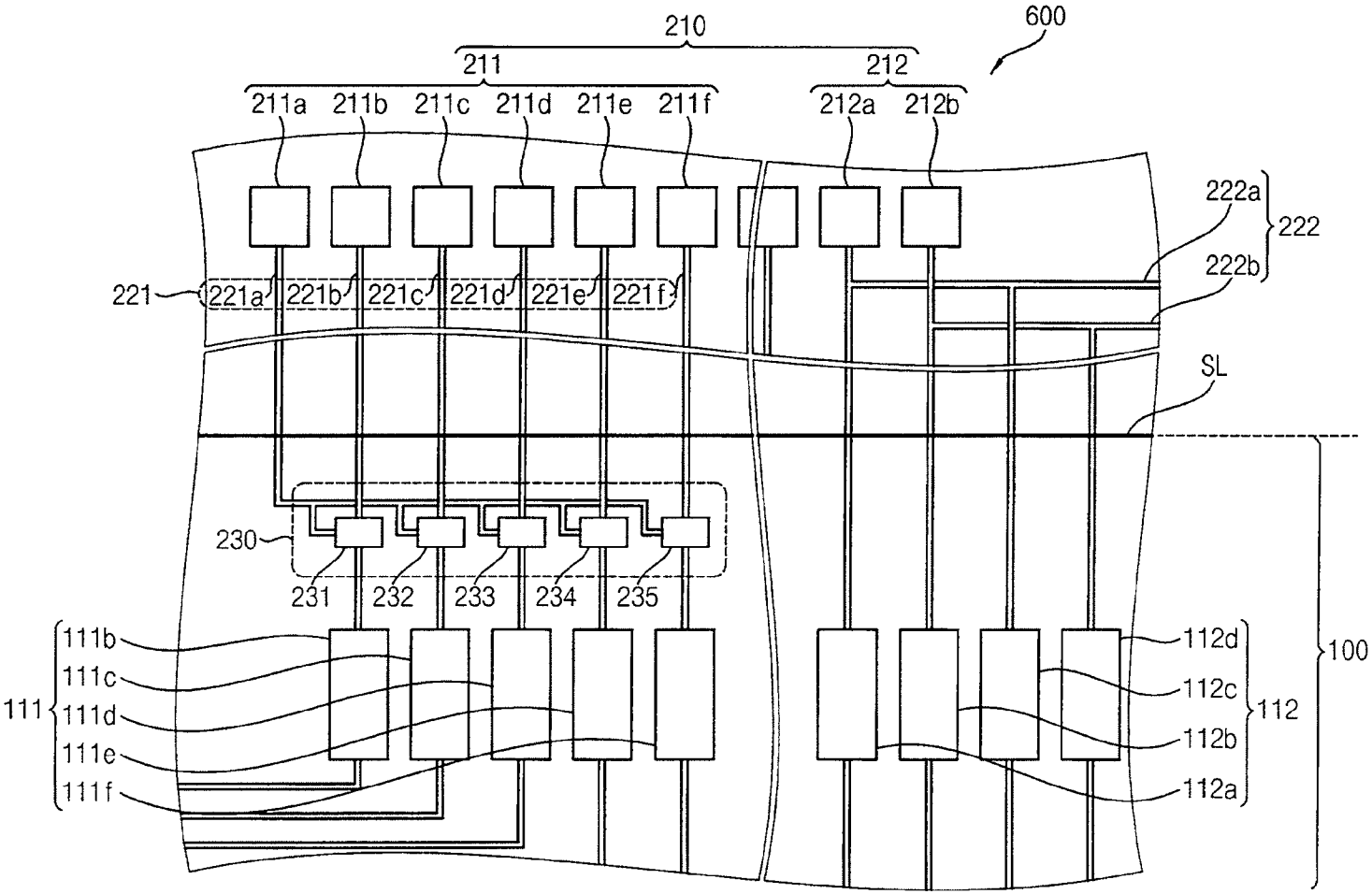
FIG. 7 illustrates a plan view of a mother substrate for a display substrate according to an exemplary embodiment.

FIG. 7 illustrates a plan view of a mother substrate for a display substrate according to another exemplary embodiment.

According to the present exemplary embodiment, a mother substrate 600 includes a switching part 230'. The switching part 230' of the present exemplary embodiment is disposed at a different position from that of the previous exemplary embodiment. Hereinafter, the same reference numerals are used to refer to the same or like parts as those described in the previous exemplary embodiments, and the same detailed explanations are not repeated unless necessary.

Referring to FIG. 7, according to the present exemplary embodiment, the mother substrate 600 may include the display substrate cell 100 and the cell peripheral area CPA surrounding the display substrate cell 100. The display substrate cell 100 and the cell peripheral area CPA may be divided based on the scribe line SL, and thus, the display substrate cell 100 may be defined by the scribe line SL. The display substrate cell 100 may include the display area DA and the peripheral area PA surrounding the display area DA.

The plurality of data lines DL, the plurality of gate lines GL, the plurality of pixel transistors TR, and the plurality of pixel electrodes PE are disposed in the display area DA of the display substrate cell 100. The switching part 230', the gate pad part 111, and the data pad part 112 are disposed in the peripheral area PA of the display substrate cell 100.

The switching part 230' is disposed adjacent to the gate pad part 111, and is connected to the gate test line part 221. The switching part 230' controls the short state and the open state of the gate test line part 221. The switching part 230' may include the first switch 231, second switch 232, third switch 233, fourth switch 234, and fifth switch 235 respectively corresponding to the gate test lines 221*b*, 221*c*, 221*d*, 221*e*, and 221*f*.

The gate pad part 111 includes the plurality of gate pads 111*b* 111*c*, 111*d*, 111*e* and 111*f*. The data pad part 112 includes the plurality of data pads 112*a*, 112*b*, 112*c* and 112*d*.

The gate test pad part 211, the data test pad part 212, the gate test line part 221, and the data test line part 222 are disposed in the cell peripheral area CPA. The gate test pad part 211 includes the test control pad 211*a* which receives a test control signal to control an operation of the switching part 230 and the plurality of gate test pads 211*a*, 211*b*, 211*c*, 211*d*, 211*e* and 211*f* which receives a plurality of gate test signals, respectively. The data test pad part 212 includes the plurality of data test pads 212*a* and 212*b* which receive a plurality of data test signals.

The gate test line part 221 connects the gate test pad part 211 and the gate pad part 111 in the display substrate cell 100, and includes the plurality of gate test lines 221*b*, 221*c*, 221*d*, 221*e* and 221*f*. The first gate test line 221*b* connects the first gate test pad 211*b* and the first gate pad 111*b* through the first switch 231. The second gate test line 221*c* connects the second gate test pad 211*c* and the second gate pad 111*c* through the second switch 232. The third gate test line 221*d* connects the third gate test pad 211*d* and the third gate pad 111*d* through the third switch 233. The fourth gate test line 221*e* connects the fourth gate test pad 211*e* and the fourth gate pad 111*e* through the fourth switch 234. The fifth gate test line 221*f* connects the fifth gate test pad 211*f* and the fifth gate pad 111*f* through the fifth switch 235. The data test line part 222 connects the data test pad part 212 and the data pad part 112 in the display substrate cell 100 and includes a plurality of data test lines 222*a* and 222*b*.

According to the present exemplary embodiment, the switching part 230' is disposed in an inside area of the display substrate cell 100 with respect to the scribe line SL. Thus, the switching part 230' remains in the display substrate cell 100 cut along the scribe line SL after the array test process. According to the present exemplary embodiment, the display substrate cell 100 includes the switching part 230'.

However, the switching part 230' that remains in the display substrate cell 100 is electrically floated. Thus, the switching part 230' is unrelated to a display of the display substrate cell 100.

By way of summary and review, according to the exemplary embodiments, the switching part 230 is turned on during the array test process, i.e., so that the array test line turns on to perform the array test process, and is turned off before and after the array test process, i.e., so that the array test line turns off when the array test process is not performed. As such, the turned off switching part 230 may prevent static electricity from flowing into the display substrate cell 100. Therefore, the gate circuit part GCP of the display substrate cell 100 may be protected from static electricity.

In contrast, in a conventional array test process of a conventional mother substrate including a display substrate, a thin film transistor on the display substrate may be damaged by static electricity. For example, the thin film transistor in the gate driving circuit may be damaged so that a reliability of the gate driving circuit may be decreased.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A mother substrate, comprising:

a display substrate cell defined by a scribe line, the display substrate cell including a plurality of gate lines, a gate circuit part driving the gate lines, and a gate pad part connected to the gate circuit part;

a gate test pad part in a peripheral area surrounding the display substrate cell, the gate test pad part receiving a gate test signal;

a gate test line part connecting the gate test pad part and the gate pad part; and a switching part connected to the gate test line part to control turning on and turning off of the gate test line part.

2. The mother substrate as claimed in claim 1, wherein the gate test pad part includes:

a test control pad to receive a test control signal which controls an operation of the switching part; and a plurality of gate test pads to receive a plurality of gate test signals which control an operation of the gate circuit part.

3. The mother substrate as claimed in claim 2, wherein the switching part includes a plurality of switching elements connecting the gate test pad part and the gate pad part in parallel, the switching elements driving in response to the test control signal.

4. The mother substrate as claimed in claim 3, wherein each of the switching elements includes a plurality of transistors connected to each other in series, the transistors driving in response to the test control signal.

5. The mother substrate as claimed in claim 2, wherein the switching part includes a switching element connecting the gate test pad part and the gate pad part, the switching element including a plurality of transistors connected to each other in series.

6. The mother substrate as claimed in claim 2, wherein the switching part is in an area adjacent to an area of the gate pad part.

7. The mother substrate as claimed in claim 2, wherein the switching part is in an outside area of the display substrate cell with respect to the scribe line.

8. The mother substrate as claimed in claim 2, wherein the switching part is in an inside area of the display substrate cell with respect to the scribe line.

9. The mother substrate as claimed in claim 2, wherein the gate test signals include a plurality of clock signals, a plurality of OFF signals, and at least one vertical start signal driving the gate circuit part.

10. An array test method of a mother substrate for a display substrate cell having a plurality of data lines, a plurality of gate lines, a gate circuit part driving the gate lines and a gate pad part connected to the gate circuit part, the array test method comprising:

turning on a gate test line part to connect the gate pad part and a gate test pad part receiving a gate test signal;

turning on a switching part while the gate test line part is turned on, such that the gate test signal is applied to the gate pad part to have the gate circuit part generate gate signals; and turning off the gate test line part after the gate circuit part completes generation of the gate signals in response to the gate test signal, wherein the switching part is turned off before turning on the gate test line part, and turned off after the gate test line part is turned off, the switching part being connected to the gate test line part.

11. The array test method as claimed in claim 10, further comprising:

applying a test control signal, which turns on the switching part, from outside to a test control pad when the gate test line part is turned on; and applying a test control signal, which turns off the switching part, from outside to the test control pad, the gate test pad part including the test control pad.

12. The array test method as claimed in claim 10, wherein the switching part includes a plurality of switching elements connecting the gate test pad part and the gate pad part in parallel.

13. The array test method as claimed in claim 12, wherein each of the switching elements includes a plurality of transistors in series.

14. The array test method as claimed in claim 10, wherein the switching part includes a switching element which connects the gate test pad part and the gate pad part, and the switching element includes a plurality of transistors in series.

15. The array test method as claimed in claim 10, further comprising applying a data test signal to a data pad part which is connected to the data lines when the gate test line part is turned on.

16. A display substrate, comprising:

a plurality of gate lines in a display area;

a plurality of data lines crossing the gate lines;

a gate circuit part in a peripheral area to drive the gate lines;

a gate pad part connected to the gate circuit part, the gate pad part receiving a gate driving signal to drive the gate circuit part; and a switching part adjacent to the gate pad part and connected to the gate pad part.

17. The display substrate as claimed in claim 16, wherein the switching part includes a plurality of switching elements connected to each other in parallel, and each of the switching elements includes a plurality of transistors connected to each other in series.

* * * * *